US007024906B2

(12) United States Patent
Potthoff

(10) Patent No.: US 7,024,906 B2
(45) Date of Patent: Apr. 11, 2006

(54) ROLL STAND FOR ROLLING BAR-SHAPED OR TUBULAR MATERIAL

(75) Inventor: Heinrich Potthoff, Hilden (DE)

(73) Assignee: Kocks Technik GmbH & Co. (DE)

( * ) Notice: Subject to any disclaimer, the term of this patent is extended or adjusted under 35 U.S.C. 154(b) by 368 days.

(21) Appl. No.: 10/238,912

(22) Filed: Sep. 10, 2002

(65) Prior Publication Data

US 2003/0051524 A1 Mar. 20, 2003

(30) Foreign Application Priority Data

Sep. 11, 2001 (DE) ..... 101 44 743

(51) Int. Cl.
*B21B 31/26* (2006.01)

(52) U.S. Cl. ..... 72/224

(58) Field of Classification Search ..... 72/224, 72/235, 237, 246, 247, 248, 249

See application file for complete search history.

(56) References Cited

U.S. PATENT DOCUMENTS

| | | | | | |
|---|---|---|---|---|---|
| 3,861,187 | A | * | 1/1975 | Leeuwestein | 72/224 |
| 4,537,054 | A | * | 8/1985 | Properzi | 72/224 |
| 5,230,236 | A | * | 7/1993 | Nakamura et al. | 72/249 |
| 5,743,126 | A | * | 4/1998 | Shore et al. | 72/237 |
| 6,490,901 | B1 | * | 12/2002 | Potthoff | 72/224 |
| 6,502,446 | B1 | * | 1/2003 | Potthoff | 72/224 |

* cited by examiner

*Primary Examiner*—Lowell A. Larson
(74) *Attorney, Agent, or Firm*—Cook, Alex, McFarron, Manzo, Cummings & Mehler, Ltd.

(57) ABSTRACT

The roll stand having at least one roll shaft 2, which carries a roll 6 and is subdivided into sectional shafts 3, 4 for the purpose of being able to change the roll, comprises at least one labyrinth-seal arrangement which is arranged in an annular gap 23, 24 formed between the respective sectional shaft 3, 4 and a bearing device for the roll shaft.

12 Claims, 4 Drawing Sheets

ROLL STAND FOR ROLLING BAR-SHAPED OR TUBULAR MATERIAL

CROSS-REFERENCE TO RELATED APPLICATIONS

The invention relates to a roll stand for rolling bar-shaped or tubular material, and claims the priority of German Patent Application 101 44 974.7, to the contents of which reference is made.

BACKGROUND OF THE INVENTION

Such roll stands always comprise a number of rolls, mostly three rolls, which are each mounted on a radially and axially adjustably roll shaft rotatably mounted in the stand housing. In this case, the rolls are arranged relative to one another in such a way that their axes of rotation lie in a plane perpendicularly to the rolling direction at the same distance from a common center point, so that respectively adjacent rolls are at the same angular distance from one another. The rolls thus together form a "roll pass".

Many configurations of roll stands of this type are known. In a special embodiment of the roll stands, the roll shafts are mounted in the stand housing by means of eccentric bushes. The distances of the roll-shaft longitudingal axes from the c ommon center point of the roll stand can thus be set in an infinitely variable manner by rotating the eccentric bushes.

In this way, the diameter of the rolled material can be influenced on the one hand, and the rolls, despite rework after wear, can be set to the same pass on the other hand, as a result of which the application times which can be achieved are considerably increased.

In order to be able to remove the rolls quickly from the stand and without complicated dismantling work and to be able to exchange them for those with a roll pass recently machined, the roll shafts are each subdivided into two sectional shafts and each roll is clamped in place between two facing end faces of the two sectional shafts in a fixed but releasable manner. The clamping force is applied by means of a tie rod arranged in a central longitudinal bore of the roll shaft and is maintained during the operation of the roll stand.

If a roll is to be changed, only the tie rod is to be released and shifted in the axial direction to such an extent that it clears the separating location of the two sectional shafts. The two sectional shafts are then to be moved apart axially to such an extent that the roll can be removed transversely to the roll shaft.

In a first roll stand having the features described above, the eccentric bushes required for the adjustability of the roll shaft accommodate both the radial bearings arranged on both sides of theroll and the axial bearing arranged on one side. Since, as described above, it is necessary to axially displace both secitonal shafts of a roll shaft for the purpose of the roll change, the axial bearing must also be displaced at the same time.

In order to achieve this, in one embodiment an additional bush accommodating the axial bearing is provided inside the eccentric bush, this additional bush being displaceable relative to the eccentric bush for the purpose of separating the two sectional shafts.

This embodiment of the roll stand has, inter alia, the following disadvantages:

The roll stand has relatively large external dimensions overall due to the relatively large outside diameter of the eccentric bush in the region of the axial bearing.

The ease of removal of the axial beaing from the eccentric bush requires a multi-piece design of the same, as a result of which its material and manufacturing costs are increased.

Due to the long type of construction of the eccentric bush, the bevel tooth system which is provided on its outer periphery and via which the eccentric bush is in engagement with an adjacent eccentric bush in order to permit the synchronous rotation can only be produced with considerable outlay.

The relatively large external dimensions of the roll stand require the use of relatively large drive units (C-frames) arranged in a stationary position in the rolling line, as a result of which the cost of entire rolling line increases out of proportion.

In a further embodiment of a roll stand, the roll shaft is designed in one piece and the axial bearing is arranged in the stand housing on the end of the roll shaft opposite the input side outside the eccentric bush. In order nonetheless to make it possible to adjust the roll, the axial bearing is configured in such a way that it permits the radial displacements of the roll shaft which are necessary for this purpose. In terms of design, this property of the axial bearing is produced by play which permits the radial shifting of the roll shaft being provided radially between the parts of the axial bearing which are connected to the roll shaft and to the stand housing.

Although the diameter of the eccentric bush is not increased in this embodiment by the axial bearing, it is a disadvantage that it is necessary to remove the axial bearing from the roll shaft in order to remove the roll, as a result of which the outlay associated with the roll change is substanstially increased.

The object of the invention is therfore to provide a roll stand in which the disadvantages described abonve are reduced.

This object is achieved by a roll stand of the present invention as set forth in the appended claimes. Owing to the fact that, in a first embodiment, in the roll stand according to the invention, the axial bearing - in general: the device for mounting the roll shaft in the axial direction - is provided on a hub, relative to which the roll shaft can selectively be shifted or fixed in the axial direction, only the roll shaft has to be released from the hub for axially shifting the two sectional shafts of the roll shaft relative to one another for the purpose of removing the roll. Complicated removal of the axial bearing from the roll shaft is not necessary.

In an alternative design of the invention, that part of the device for mounting the roll shaft in the axial direction which is connected to the stand housing is attached to the stand housing in such a way as to be releasable from outside, i.e. without previous removal of the roll shaft. In this configuration of the invention, which can also be realized in addition to the first-mentioned alternative in one and the same roll stand, the roll shaft is not displaced relative to the device for mounting the roll shaft in the axial direction for the roll change, but rather the entire axial bearing, after its release, is shifted with the roll shaft relative to the stand housing.

In both abovementioned configurations of the invention, for roll change no complicated removal of the device for mounting the roll shaft in the axial direction from the roll shaft is necessary, but rather it is merely necessary, in the first alternative, to release the roll shaft from the hub and, in the second alternative, to release the device for mounting the roll shaft in the axial direction from the stand housing.

In addition, the roll stand according to the invention is distinguished by the following advantages compared with the prior art: due to the inventive reduction in the width of the roll stand, it is possible to further reduce the stand distance, i.e. the distance between two adjacent roll stands. In this way, during the rolling of bar or tube, the length of the "thickened end", which remains as scrap, is reduced, as a result of which the production costs of the bar or tube are reduced on account of the higher yield.

Furthermore, manufacture using modern production methods is possible in an inexpensive manner due to a simple design, in particular of the eccentric bushes and the roll shafts. The manufacturing costs are also reduced by reducing the total number of components. Due to the smaller dimensions of the roll stand, the C-frames in the rolling line may also be of smaller configuration, which in turn leads to a cost saving. In addition, the simple design and the smaller total number of components contributes to an increased functional reliability of the roll stands according to the invention.

In an especially preferred embodiment of the roll stand according to the invention, the roll shaft passes at least partly through the hub. It is then possible to releasably connect the hub and theroll shaft to one another in the axial direction in a simple manner, for example by a flat nut which is screwed onto an external thread of the roll shaft and which is then in turn flange-mounted on the hub by means of screws.

The device for mounting the roll shaft in the axial direction preferably comprises bearing surfaces which are fixed relative to the stand housing and interact in the axial direction with opposed bearing surfaces which are fixed relative to the hub.

The device for mounting the roll shaft in the axial direction can be technically realized in an especially simple manner when the bearing surfaces are formed by a bearing ring which is connected or can be connected to the stand housing.

The opposed bearing surfaces are then preerably formed in an annular groove provided in the hub or the roll shaft.

Cylinder roller bodies via which the bearing surfaces and the opposed bearing surfaces interact are preferably provided.

The number of components of the roll stand can be further reduced if the hub is part of a couplind device for coupling a rotary drive for the roll shaft.

For torque transmission, the hub is preferably provided with an internal tooth system which engages in a complementary external tooth system provided in the roll shaft.

For the purpose of shifting the roll shaft in the radial direction by the adjusting displacement, the bearing deive preferably has an eccentric bush which is arranged in the stand housing and can be selectively rotated about an axis parallel to the roll-shaft longitudinal axis and fixed in a desired angular position, and the outer, at least partly cylindrical lateral surface of which is formed eccentrically to its at least partly cylindrical inner lateral surface.

If the eccentric bush is designed to be split in two in a plane transversely to the roll-shaft longitudinal axis, the two eccentric bush parts, for fitting, can be inserted one after the other into the opening of the stand housing, through which the roll protrudes from the housing in the fitted state. The housing can therefore be designed in one piece.

In a preferred embodiment, the roll shaft is mounted in the eccentric bush via at least one radial roller bearing.

A roll can be exchanged in an especially simple manner when the roll shaft is designed to be split into two sectional shafts in a plane running perpendicularly to the roll-shaft longitudinal axis, the sectional shafts being configured in such a way that a roll can be clamped in place between the two end faces, facing one another, of the two sectional shafts.

The sectional shafts then preferably each have a central longitudinal bore, in which a tie rod, which can be selectively released and removed, is provided for producing the clamping force.

Two exemplary embodiments of the invention are shown in the drawing, in which:

Figure 1:
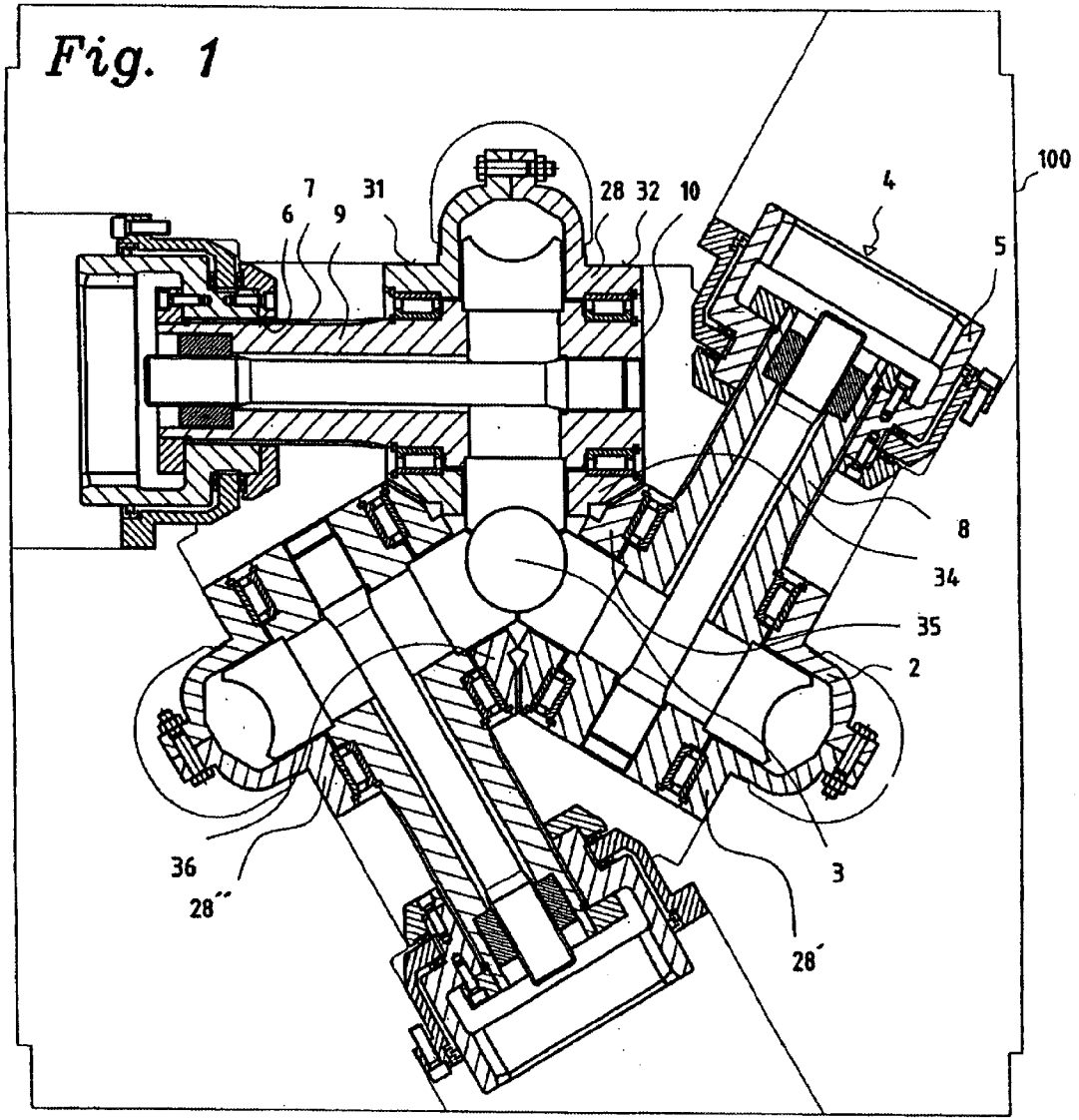
FIG. 1 shows a first embodiment of a roll stand according to the invention in cross section.

The roll stand shwon in FIG. 1 and designated overall by 100 comprises a stand housing 1 in which three rolls 2 are arranged in a star shape in such a way that they enclose a common roll axis 3 in the process. Each of the rolls 2 has a separate input 4, on which a drive torque for the respective roll 2 is exerted from a rotary drive unit (not shown). The torque is transmitted to the roll via a coupling part 5 which is of rotationally symmetrical design and is connected in a rotationally locked manner to a roll shaft 8 via an internal tooth system 6 and an external tooth system 7 provided on the roll shaft 8.

Each of the roll shafts consists of two sectional shafts 9, 10. A roll 2 is clamped in place in each case between those end faces 11, 12 of the sectional shafts 9, 10 which face one another. To this end, the roll 2 has a radially symmetrical through-bore 13. For the purpose of centering the roll 2 on the roll shaft 8, the end faces 11, 12 are provided with radially symmetrical shoulders 14, 15, the radii of which are adapted to the diameter of the through-bore 13.

A tie rod 16 which passes through the sectional shafts 9, 10 in central longitudinal bores 17, 18 serves to apply the clamping force for clamping the roll 2 in place between the sectional shafts 9, 10. The end remote from the coupling part 5 has an external thread 20 which engages in a corresponding internal thread 21 which is provided in the longitudinal bore 18 of the sectional shaft 10. At its opposite end section 22, the tie rod 16 carries a clamping nut 23, which can be screwed from outside onto the end section 22 and is supported in the tightened state on a supporting surface 24 of the sectional shaft 9 in the direction of the roll-shaft longitudinal axis L. The roll shaft 8 is rotatably mounted by means of rolling-contact bearing 25 arranged on both sides of the roll 2. In this case, the rolling-contact bearings 25 are located in the halves 26, 27 of an eccentric bush 28, which are divided in a plane E perpendicularly to the roll-shaft longitudinal axis L.

Each half 26, 27 of the eccentric bush 28 has an outer seating surface 29, 30 which is circular in cross section and bears against the stand housing 1 in each case in a corresponding recess 31, 32. The two halves 26, 27 of the eccentric bush 28 are connected to one another via a connecting stirrup 33.

From the roll shaft 8 extending horizontally in FIG. 1, the eccentric bush 28 has a bevel-gear-like toothed segment 34 which engages in a toothed segment 35 of the eccentric bush 28' which is adjacent in the clockwise direction in FIG. 1. This toothed segment 35 in turn engages in a toothed segment 36 of the eccentric bush 28" which is once again adjacent in the clockwise direction, whereas the toothed segments 34, 36 of the eccentric bush 28 and of the eccentric bush 28" are not in engagement. This measure causes all the eccentric bushes to be actuated synchronously by rotary actuation of one of the eccentric bushes 28, 28', 28". Since the rolling-contact bearings 25 are arranged eccentrically to the seating surfaces 29, 30, the roll shafts 8 and the respectively associated roll 2 are shifted in the radial direction by the rotary movements of the eccentric bushes 28, 28', 28", so that the rolls 2 can thereby be adjusted relative to the roll axis 3.

A device which is designated overall by 37 and is intended for mounting the roll shaft in the axial direction, i.e. in the direction of the roll-shaft longitudinal axis L, is provided on the side of the input 4. This device comprises an insert 38 which is connected to the stand housing by screwing and on which a bearing ring 39 extending radially with regard to the roll-shaft longitudinal axis L is integrally formed. The two end faces of the bearing ring opposite one another form bearing surfaces 40, 41, on which a plurality of cylinder roller bodies 42 roll. The cylinder roller bodies 42 in turn are supported on opposed bearing surfaces 43, 44 which are formed by radial straight surfaces 45, 45' which face one another and are provided at an axial distance apart on the parts 46 and 47 in the exemplary embodiment of the invention shown in FIGS. 1 and 2, the parts 46 and 47 together forming the hub 48.

The end of the hub which points away from the roll 2 forms in turn the coupling part 5. The bearing ring 39 and the straight surfaces 45, 45' are dimensioned in such a way that a clearance space remains between the base area 49 between the straight surfaces 45, 45' and the ring inner surface 50, this clearance space being larger than the adjusting displacement to be effected in the radial direction by means of the eccentric bush 28.

Figure 2:
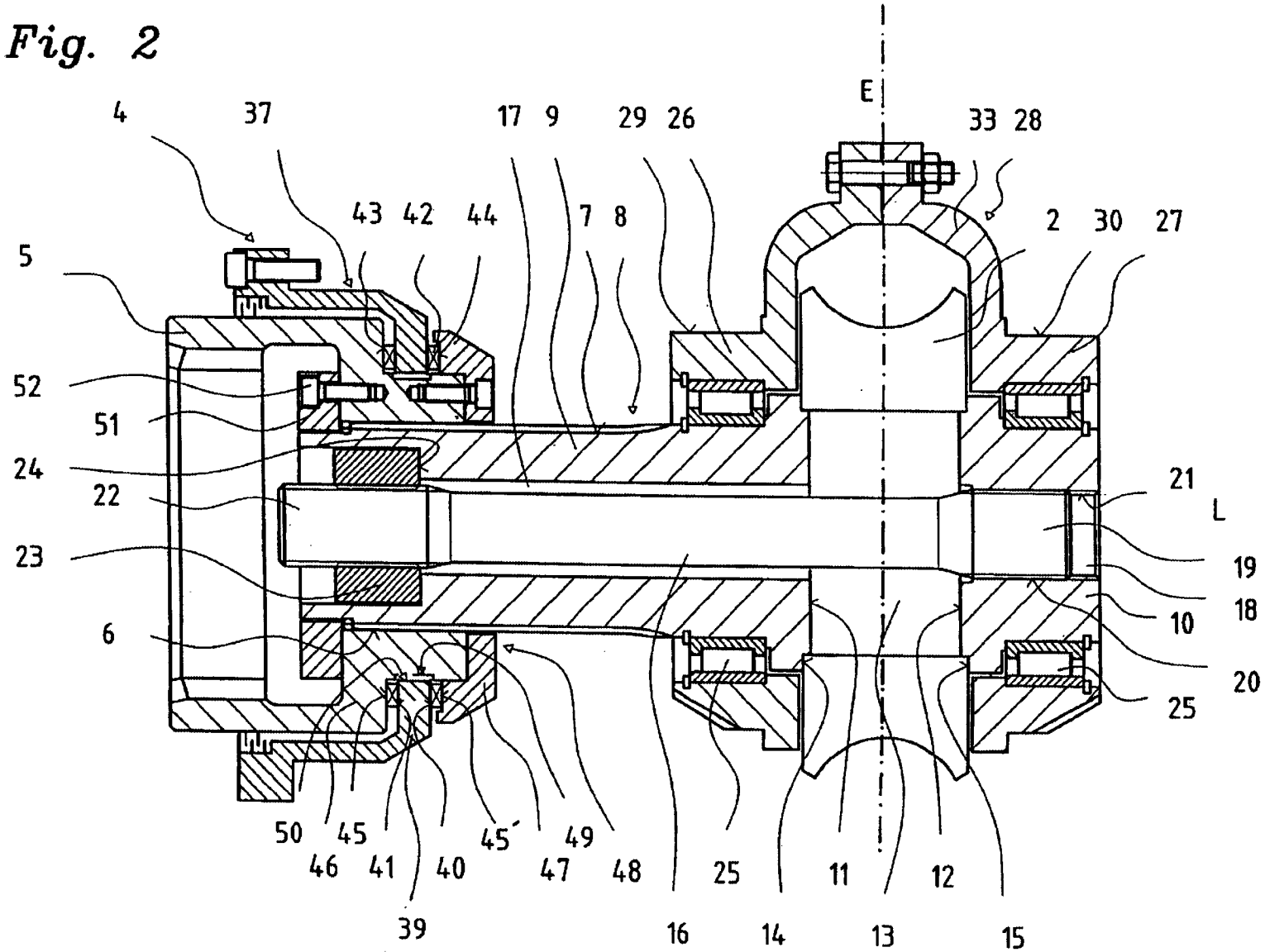
FIG. 2 shows a roll shaft of the same embodiment in an enlarged representation in the same view.

In the direction of the roll-shaft longitudinal axis L, the hub 48 is releasably fixed to the roll shaft 8 by a flat nut 51 which is screwed onto a corresponding thread in the end region of the sectional shaft 9 and is in turn fastened to the hub 48 by means of a number of screws 52 screwed into the hub (only one screw 52 is shown in FIG. 2 for the sake of clarity).

With this embodiment of the roll stand according to the invention, a simple and quick roll change is possible in the following way: first fo all the screws 52 are released. After further slackening of the clampening nut 23, unscrewing of the tie rod 16 from the sectional shaft 10 and shifting back said tie rod 16 until its end 19 remains in the outer periphery of the sectional shaft 9, the sectional shafts 9 and 10 can be moved apart, as a result of which the roll 2 is released from the shoulders 14, 15 and can be removed from the opening of the stand housing. It becomes clear that the removal and fitting, taking place in the opposite sequence by the samed steps, of a roll 2 can be carried out in a simple manner without having to dismantle the device 37 for mounting the roll shaft in the axial direction.

Figure 3:
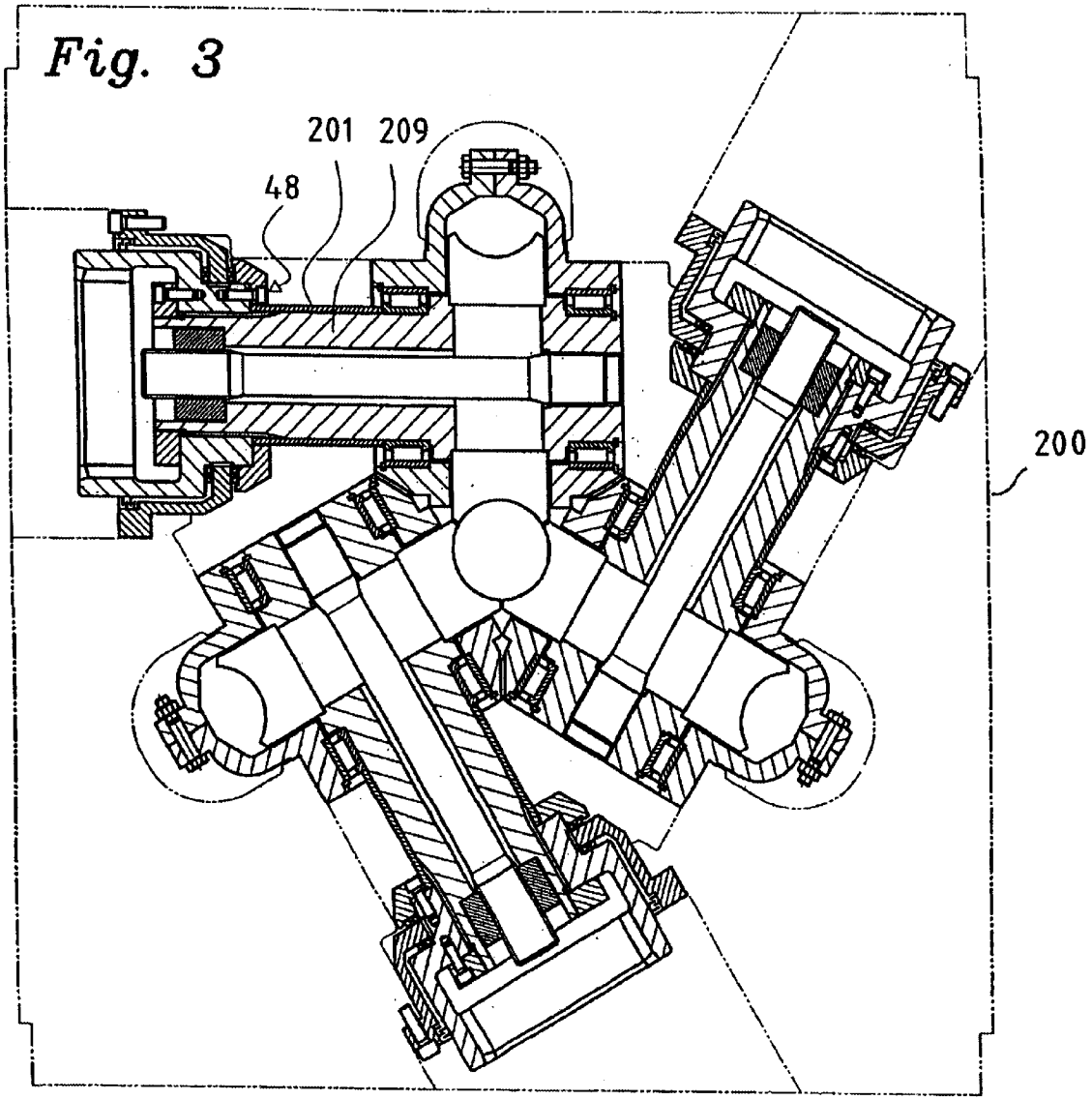
FIG. 3 shows a further embodiment of the invention in a view corresponding to FIG. 1.
Figure 4:
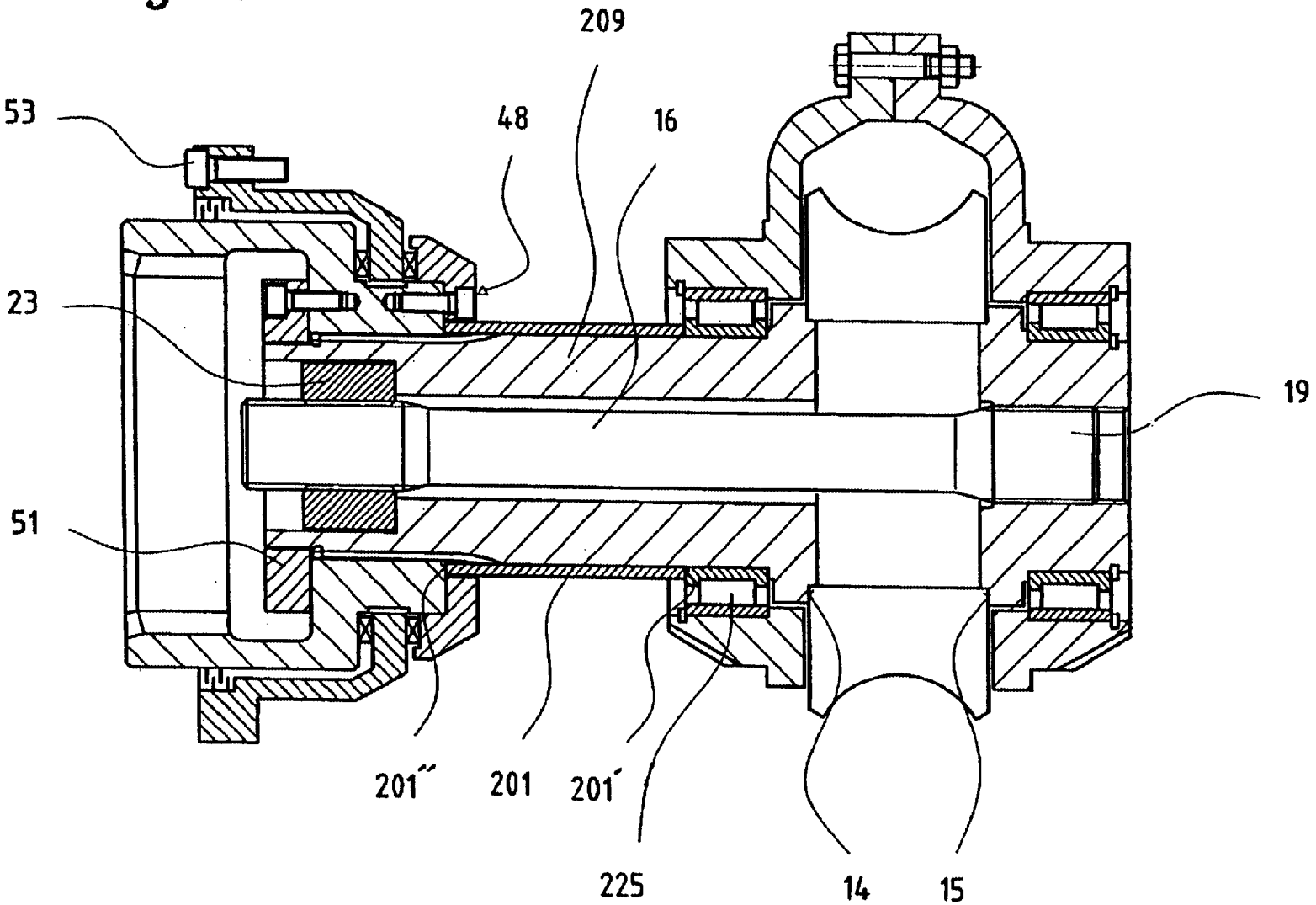
FIG. 4 shows a roll-shaft arrangement of the embodiment according to FIG. 3 in a view corresponding to FIG. 2.

A further embodiment according to the invention of a roll stand 200 is shown in FIGS. 3 and 4. In order to avoid repetitions, only the differences from the embodiment of the roll stand 100 according to FIGS. 1 and 2 are to be explained below.

As can be seen in particular from FIG. 4, a sleeve 201 enclosing the sectional shaft 209 is provided, this sleeve 201 being supported with its one front end 201' against the input-side rolling-contact bearing 225 and with its other front end 201" against the hub 48. The latter is again fastened to the sectional shaft 209 by means of the flat nut 51, the flat nut 51 being tightened to such an extent that the hub 48 is seated free from play between the flat nut 51 and the sleeve 201.

As follows from the above and as can be seen from FIG. 4, a relative displacement between the hub 48 and the sectional shaft 209 in the sense of the above-described embodiment according to FIGS. 1 and 2 is not possible. Nonetheless, a quick roll change can be effected in a simple manner, as described below:

First of all, screws 53 with which the hub 48 is fastened to the stand housing in such a way as to accessible from outside are released. After further slackening of the clamping nut 23, unsrewing of the tie rod 16 from the sectional shaft 10 and shifting back said tie rod 16 until its end 19 remains in the outer periphery of the sectional shaft 209, the sectional shafts can now be moved apart by pulling the entire hub 48 out of the stand housing, as a result of which the roll 2 is again released from the shoulders 14, 15 and can be removed from the opening of the stand housing.

The fitting of a new of reworked roll takes place in the opposite manner.

What is claimed is:

1. A roll stand (100) for rolling bar-shaped or tubular material, having a stand housing (1), having a plurality of rolls (2) which are each arranged on a rotatably mounted roll shaft (8), having at least one bearing device which is arranged in the stand housing (1) and in which a roll shaft (8) is radially mounted, the bearing device being configured in such a way that the roll shaft (8) can be selectively shifted by an adjusting displacement in the radial direction and fixed within the adjusting displacement, having at least one device (37) comprising a part connected to the roll shaft and a part connected to the stand housing and intended for mounting the roll shaft in the axial direction, this device enabling the roll shaft (8) to be shifted in the radial direction at least by the adjusting displacement, wherein that part of the device (37) for mounting the roll shaft in the axial direction which is connected to the roll shaft (8) is provided on a hub (48), relative to which the roll shaft (8) can selectively be either shifted or fixed in the axial direction, and/or that part of the device (37) for mounting the roll shaft in the axial direction which is connected to the stand housing (1) is attached to the stand housing (1) in such a way as to be releasable from outside.

2. The roll stand as claimed in claim 1, wherein the roll shaft (8) passes at least partly through the hub (48).

3. The roll stand as claimed in claim 1, wherein the device (37) for mounting the roll shaft in the axial direction comprises two bearing surfaces (40, 41) which are fixed relative to the stand housing (1) and interact in the axial direction with two opposed bearing surfaces (43, 44) which are fixed relative to the hub (48).

4. The roll stand as claimed in claim 3, wherein the bearing surfaces (40, 41) are formed by a bearing ring (39) which is connected or can be connected to the stand housing (1).

5. The roll stand as claimed in claim 3, wherein the opposed bearing surfaces (43, 44) are formed by straight Surfaces (45, 45') provided at an axial distance apart in the hub (48).

6. The roll stand as claimed in claim 3, wherein the bearing surfaces (40, 41) and the opposed bearing surfaces (43, 44) interact via cylinder roller bodies (42).

7. The roll stand as claimed in claim 1, wherein the hub (48) is part of a coupling device for coupling a rotary drive for the roll shaft (8).

8. The roll stand as claimed in claim 1, wherein the hub (48) comprises an internal tooth system (6) and the roll shaft (8) comprises an external tooth system (7) complementary to the internal tooth system.

9. The roll stand as claimed in claim 1, wherein the bearing device comprises an Eccentric bush (28, 28', 28") which is arranged in the stand housing (1) and can be selectively rotated about an axis parallel to the roll-shaft longitudinal axis (L) and fixed in a desired angular position, and the outer, at least partly cylindrical lateral surface of which is formed eccentrically to its at least partly cylindrical inner lateral surface.

10. The roll stand as claimed in claim 9, wherein the roll shaft (8) is mounted in the eccentric bush (28, 28', 28") via at least one rolling-contact bearing (25).

11. The roll stand as claimed in claim 1, wherein the roll shaft (8) is designed to be split into two sectional shafts (9, 10) in a plane cruising perpendicularly to the roll-shaft longitudinal axis (L), the sectional shafts (9, 10) being configured in such a way that a roll (2) can be clamped in place between the two end faces (13, 12), facing one another, of the two sectional shafts (9, 10).

12. The roll stand as claimed in claim 11, wherein the sectional shafts have central longitudinal pores (17, 18), in which a tie rod (16), which can be selectively released and removed, is provided for producing the clamping force.

* * * * *